US009182112B2

(12) United States Patent
Brown et al.

(10) Patent No.: US 9,182,112 B2
(45) Date of Patent: Nov. 10, 2015

(54) SHEET LIGHTING IN AN APPLIANCE

(75) Inventors: Justin T. Brown, Louisville, KY (US); Howard James Oagley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 160 days.

(21) Appl. No.: 12/949,843

(22) Filed: Nov. 19, 2010

(65) Prior Publication Data

US 2012/0127729 A1 May 24, 2012

(51) Int. Cl.

| | |
|---|---|
| ***F21V 7/00*** | (2006.01) |
| ***F21V 33/00*** | (2006.01) |
| ***F24C 15/00*** | (2006.01) |
| ***F24C 15/20*** | (2006.01) |
| *F21Y 101/02* | (2006.01) |

(52) U.S. Cl.

CPC ..... *F21V 33/0044* (2013.01); *F24C 15/008* (2013.01); *F24C 15/2064* (2013.01); *F21Y 2101/02* (2013.01)

(58) Field of Classification Search

USPC ..... 362/310, 294, 373, 296.03, 92, 235

See application file for complete search history.

(56) References Cited

U.S. PATENT DOCUMENTS

| | | | | |
|---|---|---|---|---|
| 3,117,245 | A * | 1/1964 | Ehrreich | 313/483 |
| 6,123,431 | A | 9/2000 | Teragaki et al. | |
| 7,157,667 | B2 * | 1/2007 | Gramlich et al. | 219/391 |
| 7,628,525 | B2 | 12/2009 | Lee et al. | |
| 2005/0276072 | A1 * | 12/2005 | Hayashi et al. | 362/609 |
| 2007/0125760 | A1 * | 6/2007 | Kim et al. | 219/391 |
| 2009/0021927 | A1 | 1/2009 | Hall et al. | |
| 2009/0080178 | A1 * | 3/2009 | Wilsdorf | 362/92 |
| 2009/0272136 | A1 * | 11/2009 | Knoll et al. | 62/251 |
| 2009/0316385 | A1 | 12/2009 | Weber et al. | |
| 2010/0139638 | A1 * | 6/2010 | Hargrave et al. | 126/19 R |

FOREIGN PATENT DOCUMENTS

| | | | |
|---|---|---|---|
| EP | 971186 | B1 | 1/2000 |
| EP | 2128526 | A1 | 12/2009 |
| WO | 2009/141069 | A1 | 11/2009 |

* cited by examiner

*Primary Examiner* — Anh Mai
*Assistant Examiner* — Jessica M Apenteng
(74) *Attorney, Agent, or Firm* — Dority & Manning, P.A.

(57) ABSTRACT

A lighting system for an appliance includes a panel having a side and an exposed edge, a light source positioned in proximity to the exposed edge of the panel, and a coating disposed over a surface of the side of the panel. The coating is configured to allow light to diffuse from the coated side of the panel and the panel is located remotely from the light source.

8 Claims, 10 Drawing Sheets

SHEET LIGHTING IN AN APPLIANCE

BACKGROUND OF THE INVENTION

The present disclosure generally relates to appliances, and more particularly to surface lighting in an appliance.

Lighting in an appliance is typically by using a point source such as bulb. The light sources for appliances will generally include, for example, incandescent bulbs and halogen lamps. These light sources tend to reach a very high intensity and can be unpleasant to look at directly. This can be especially problematic when inspecting food on a rack in an oven or an object on a shelf in a refrigerator. Lamp style devices can also be bulky and can generate heat, which may be undesirable in certain applications, such as refrigerators or freezers.

Additionally, the bulb type light sources typically used in appliances such as refrigerators or ovens are also very difficult to diffuse evenly within the appliance. Halogen light sources are typically considered for appliance lighting. Bulbs, such as halogen bulbs, will typically mounted behind a heavily diffused glass lens. In an oven application, this type of assembly has limitations on distributing the light to certain rack positions. Additionally, halogen lighting is not the most energy efficient, and the bulbs have a limited lifespan.

Light sources, such as light emitting diodes or LEDs, are being considered as alternative to bulb style lighting due to their energy efficiency and reduced heat output. However, LEDs are sensitive to temperature and need to be kept in a cool environment. Thus, LED lighting applications in appliances, such as an oven, become difficult to manage.

It would be advantageous to be able to diffuse light evenly in an appliance. It would also be advantageous to be able to control the light intensity in various areas of an appliance. Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a lighting system for an appliance. In one embodiment, the lighting system includes a panel having a side and an exposed edge, a light source positioned in proximity to the exposed edge of the panel, and a coating disposed over a surface of the side of the panel, the coating configured to allow light to diffuse from the coated side of the panel.

In another aspect, the disclosed embodiments are directed to an illumination system for an oven. In one embodiment, the system includes an oven cavity with an oven cavity liner, a light transmitting panel disposed on a surface of the oven cavity liner, a light source coupled to an edge of the light transmitting panel, and a coating on a surface of the light transmitting panel, the coating configured to allow light to diffuse from the coated surface of the light transmitting panel.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
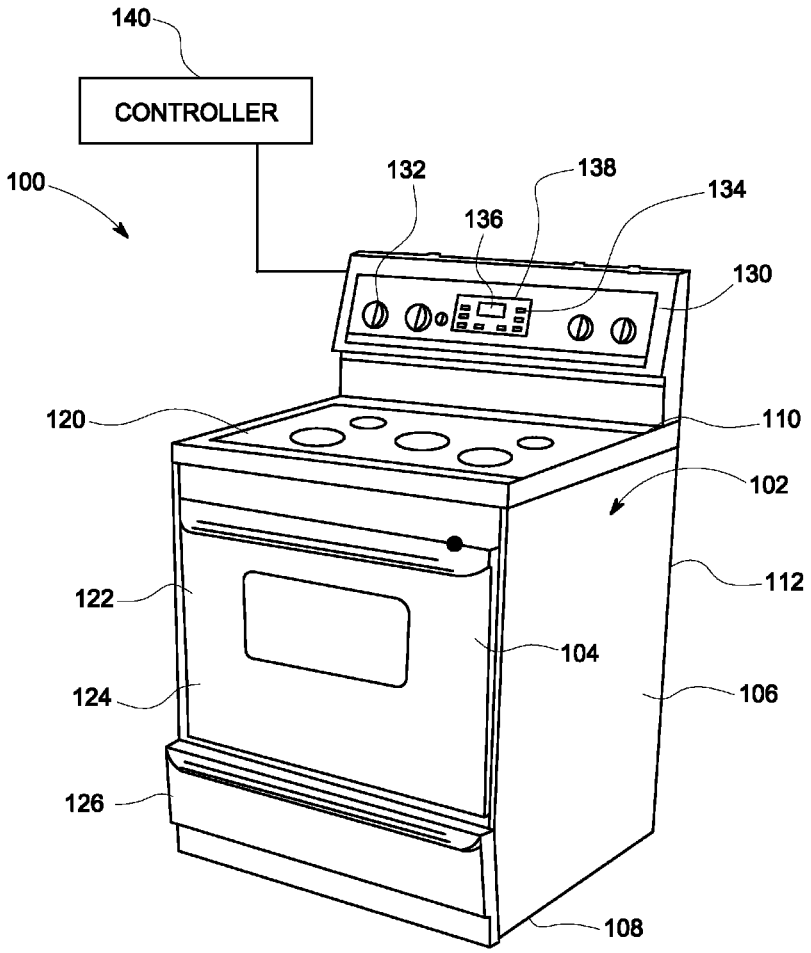
FIG. 1 is a perspective view of an exemplary range incorporating aspects of the disclosed embodiments.

Referring to FIG. 1, an exemplary appliance such as a freestanding range in accordance with the aspects of the disclosed embodiments is generally designated by reference numeral 100. The aspects of the disclosed embodiments are generally directed to edge lighting a sheet or panel of a light transmitting material onto which a coating has been applied. The coating allows the light to escape from the panel and illuminate a desired area. The coating can be applied to one or both sides of the panel to generate a desired light output. The coating can include a pattern that can be varied in order to shift the intensity of the light and optimize the desired light output. The panels can be mounted to a suitable portion of the appliance, such as the side walls, top, back, door or a shelf to illuminate its interior, or even provide exterior lighting. Although a range 100 is shown in FIG. 1, the aspects of the disclosed embodiments can be applied to any appliance such as a cooktop, refrigerator, range hood, dishwasher, washer or dryer, for example.

As is shown in FIG. 1, the range 100 includes a cabinet or housing 102 that has a front portion 104, opposing side panels 106, a base or bottom portion 108, a top portion 110, and a back panel 112. The top portion 110 of the range 100 includes a cooktop 120. Alternate embodiments can include wall ovens.

The range 100 also includes an oven unit 122. Although the aspects of the disclosed embodiments are described herein with respect to the single oven configuration shown in FIG. 1, in alternate embodiments, the range 100 could comprise a multiple oven unit. For example, the range 100 can include a free standing gas or electric range, a wall oven, a gas oven, a speed cooking oven or a dual fuel oven. The range 100 includes an oven door 124 and a pullout drawer 126, the operation of which is generally understood.

In one embodiment, the cabinet 102 of the range 100 includes a control surface 130 that supports one or more controls, generally referred to herein as burner controls 132. The burner control or control knob 132 shown in FIG. 1 is generally in the form of a knob style control that extends outwardly from and can be supported by the control surface 130, which in one embodiment comprises a backsplash. In one embodiment, a control panel 138 includes a plurality of input selectors or switches 134 and a display 136 cooperating with burner control knob 132 to form a user interface for selecting and displaying cooking cycles, warming cycles and/or other operating features, including enabling lighting of an interior of the oven unit 122. In one embodiment, the input selectors or switches 134 can be in the form of push buttons or electronic switches.

In one embodiment, the range 100 includes a controller 140. The controller 140 is coupled to, or integrated within, the control panel 138 and configured to receive inputs and commands from for example, the controls 132 and 134, and control the various operations and functions of the range 100. In one embodiment, the controller 140 can include or comprise an electronic range control. and can be used to control the lighting system of the oven unit 122, as is further described herein.

Figure 2:
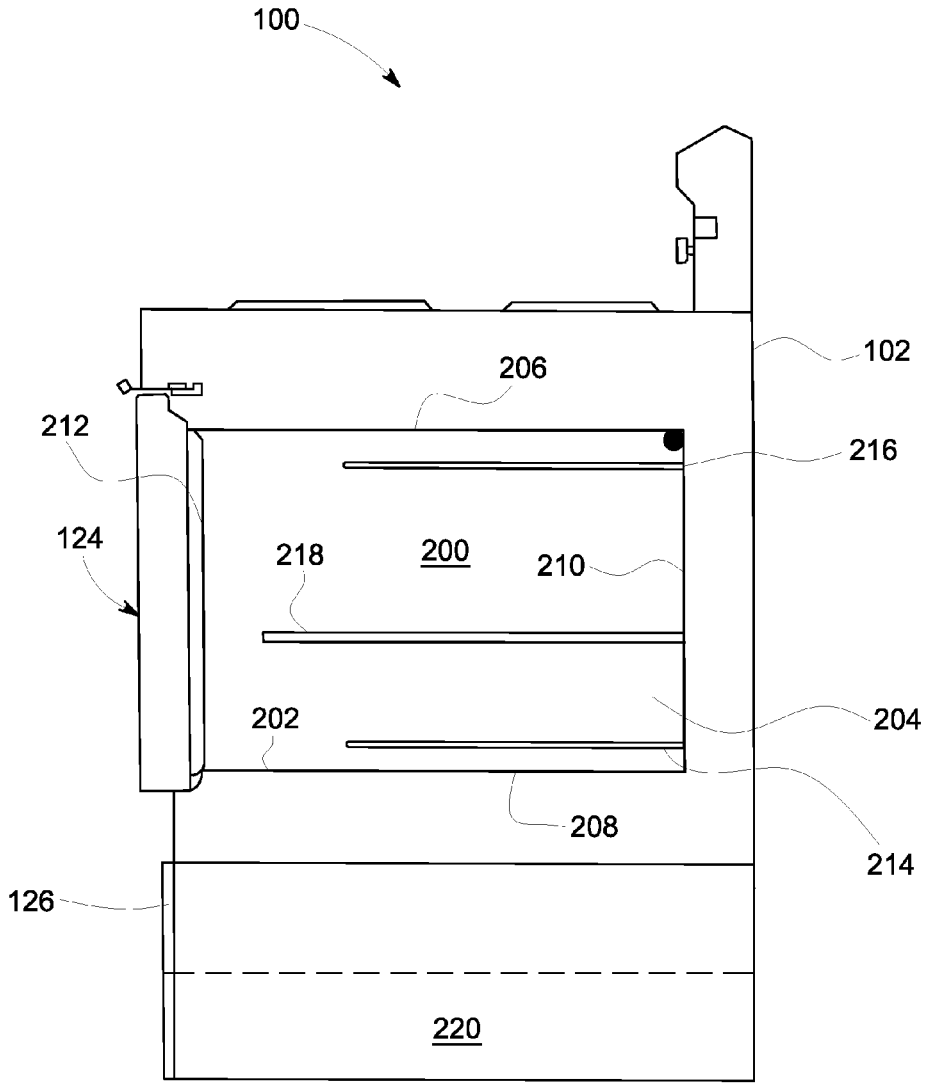
FIG. 2 is a cross-sectional view of the range illustrated in FIG. 1.

FIG. 2 is a cross-sectional side view of the range 100 shown in FIG. 1. Positioned within cabinet 102 is a cooking chamber or oven cavity 200. The oven cavity 200 is formed or defined by a box-like wall or oven liner 202. The oven liner 202 has at least two vertical side panels or walls 204 (only one of which is shown in FIG. 2), a top panel or wall 206, a bottom panel or wall 208, a rear panel or wall 210, and a door or front panel or wall 212. In the embodiment shown in FIG. 2, the door 124 is a front opening door. In alternate embodiments, any suitable door can be used. In one embodiment, the rear or back panel 210 of the oven cavity 200 can also include a fan and convection fan cover (not shown) that are suitably attached to, or part of the back panel 210, and for purposes of the description herein, are considered part of the back panel 210.

The oven cavity 200 is provided with at least one heating element, such as a lower heating element 214 or upper heating element 216. In one embodiment, the lower heating element 214 is positioned adjacent to the bottom panel 208 and the upper heating element 216 is positioned adjacent to the top panel 206. In one embodiment, the lower and upper heating elements 214, 216 are referred to as bake and broil heating elements, respectively. In alternate embodiments, the heating elements can be arranged in any suitable manner. In an exemplary embodiment, at least one cooking rack 218 for supporting an object is positioned within the oven cavity 200.

In one embodiment, the range 100 also includes a second oven or warming platform 220 coupled to and positioned beneath the oven cavity 200. The warming platform 220 is accessed via the door 126.

Figure 3:
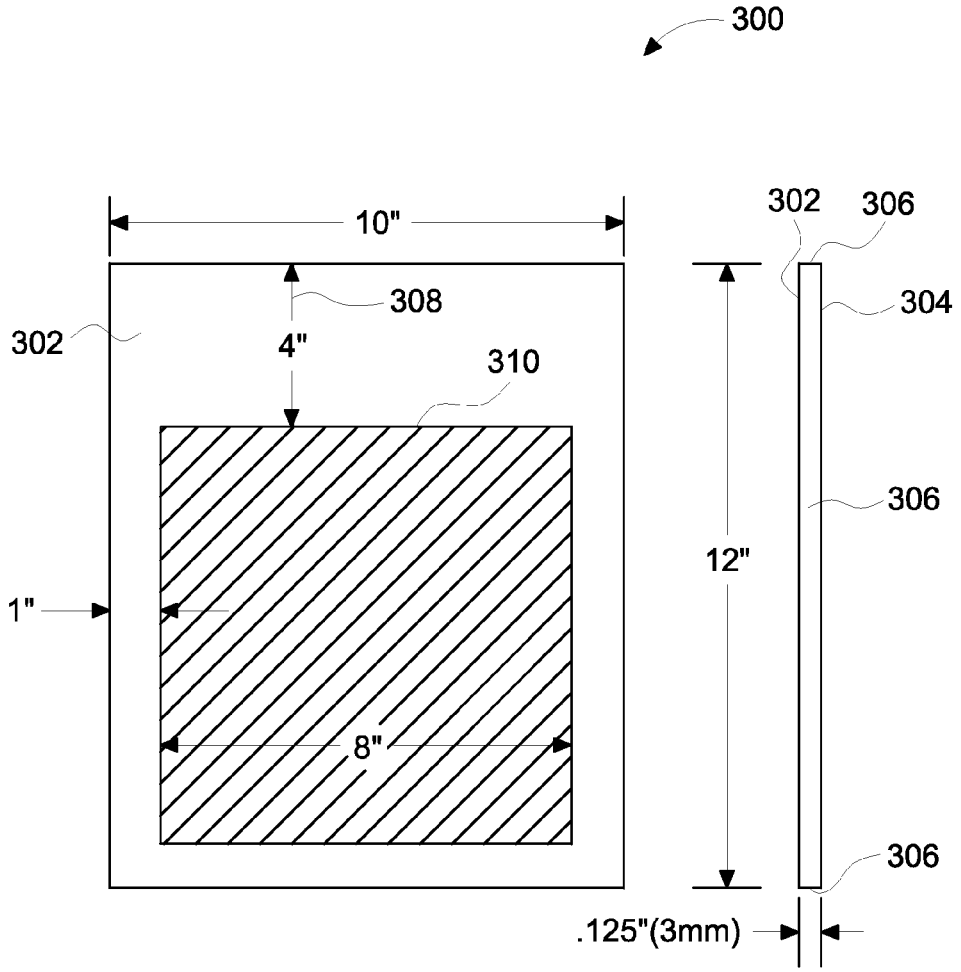
FIG. 3 is a plan view of a light transmitting panel incorporating aspects of the disclosed embodiments.

The aspects of the disclosed embodiments are directed to edge lighting a sheet or panel of a light transmitting material. A coating is applied to the sheet and the coating is used to generate a light output from the light transmitting material in a desired direction, intensity and pattern. FIG. 3 illustrates an exemplary panel or sheet 300 of light transmitting material that can be used in conjunction with the aspects of the disclosed embodiments.

The panel 300 generally comprises a material such as glass or plastic. In alternate embodiments, any suitable light transmitting material can be used for the panel 300. The panel 300 includes two sides 302, 304, generally referred to herein for description purposes as a top side 302 and bottom side 304, but could also be referred to as first and second sides or front and back sides, depending upon the application and orientation of the panel 300. The panel 300 includes four outer edges, generally referred to as edge 306. As is shown in FIG. 3, a coating 310 is disposed on the surface of the side 302. Although the coating 310 is shown on the side 302 in FIG. 3, in alternate embodiments, a coating 310 can be disposed on one or both of the surfaces of each side 302, 304. In an oven application, the typical temperatures that the panel 300 can be exposed to can range from approximately 25 degrees Centigrade (77 degrees Fahrenheit) to approximately 450 degrees Centigrade (842 degrees Fahrenheit). In a range vent hood applications, the typical high temperature would be about 120 degrees Centigrade (248 degrees Fahrenheit) and approximately 70 degrees Centigrade (158 degrees Fahrenheit) in a dishwasher and washer application. In an oven application, the coating 310 on the panel 300 can be a ceramic paint, which is capable of withstanding self-clean temperatures of the oven.

One or more of the edges 306 of the panel 300 are configured to receive light from a light source. As will be understood, the light that enters the solid panel 300 from the edge 306 will remain inside of the panel 300 if the surrounding fluid has a much lower index of refraction. For example, light transmitted into the glass sheet will stay inside of the glass sheet since its index of refraction is greater than air. By coating the panel 300 on one or more of the sides 302, 304, the light that reflects from the coating will reflect in some angles that exceed a critical angle and thus allow the light to escape or transmit out of the panel 300. The coating can also be patterned in order to achieve a desired light output in certain areas. For example, increasing the density of the pattern in one area of the coating 310 can increase the amount of light that is emitted from that area relative to an area that is less densely coated. The coating pattern could also include geometric shaping on the surface of the panel 300, such as by molding or etching small bumps onto the panel 300.

As is illustrated in FIG. 3, in one embodiment, only a portion of the side 302 includes the coating 310. The application of the coating 310 can be limited to or be suitably sized to provide or optimize the desired illumination, and the coating 310 can encompass more or less than the total surface area of the respective sides 302, 304. In the example shown in FIG. 3, the overall dimensions of the panel 300 are approximately 10 inches by 12 inches. In alternate embodiments, the panel 300 can be suitably sized for the particular application. As shown in FIG. 3, the coating 310 encompasses an area that is approximately eight inches by seven inches on the panel 300. In one embodiment, the coating 310 can be offset, with an approximately one inch margin on three of the sides, and a four inch margin on the fourth side, identified as gap 308. A thickness of the panel 300 is approximately 0.125 inches. The dimensions used in this example are specific to the oven application referred to in FIG. 1. In alternate embodiments and applications, the panel 300 and the area encompassed by the coating 310 can be of any suitable size and accordingly positioned on the panel 300.

Figure 4:
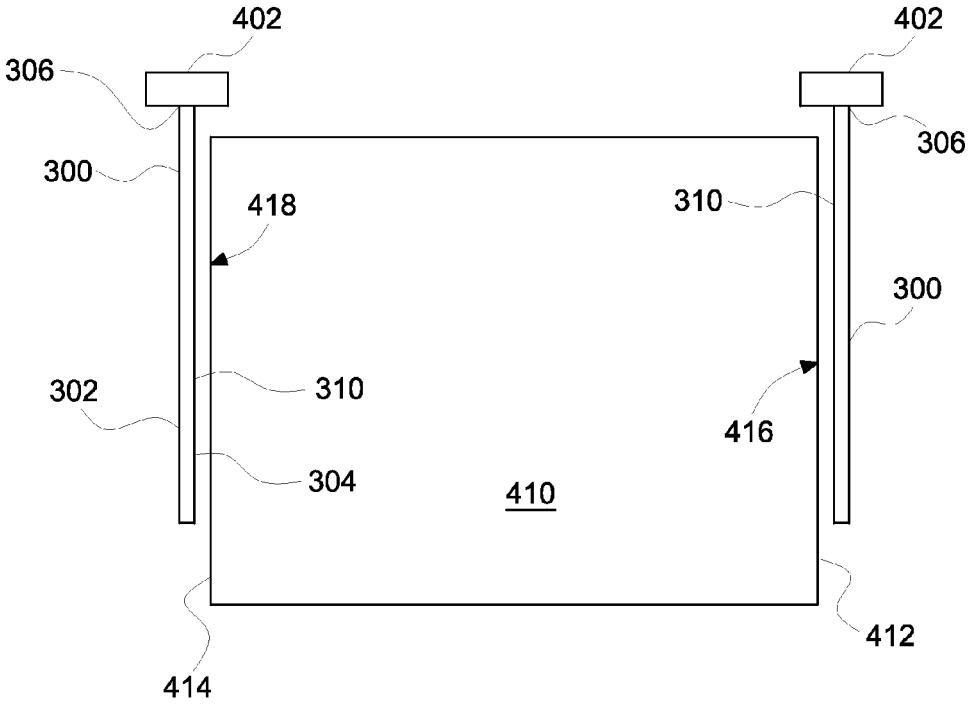
FIG. 4 is a top cross-sectional view of a lighting application incorporating aspects of the disclosed embodiments.
Figure 5:
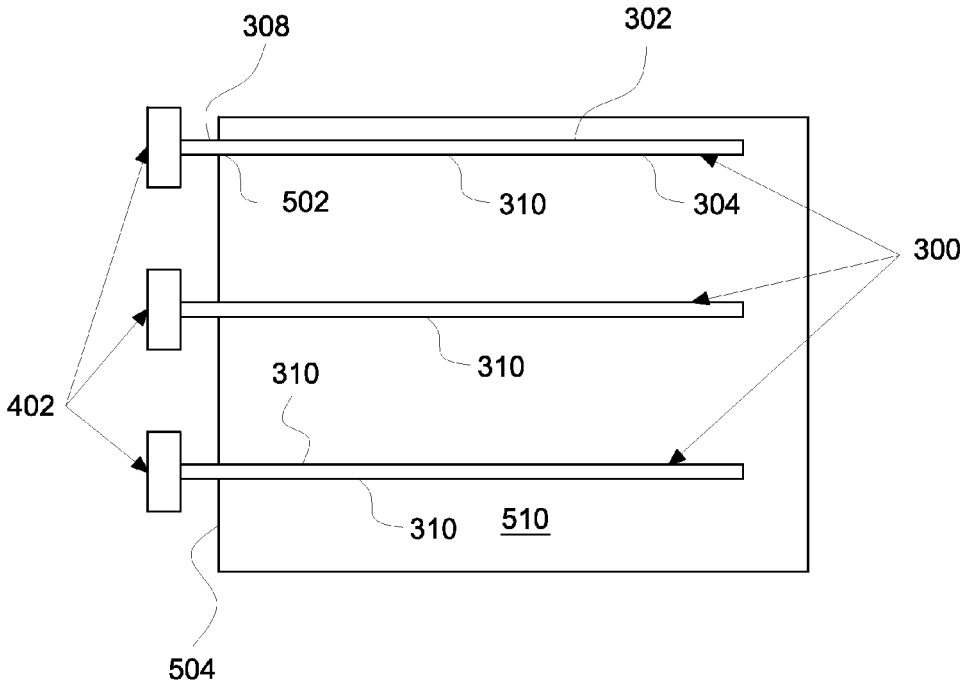
FIG. 5 is a side cross-sectional view of a lighting application incorporating aspects of the disclosed embodiments.

FIGS. 4 and 5 illustrate different embodiments of the application of a lighting panel for illuminating an area as is described herein. Referring to FIG. 4, in this example, two lighting panels 300 are being used to illuminate an area 410, which could be the interior of a cavity, compartment or cabinet, for example. In this example, a light emitting diode, or LED array 402 is positioned in close proximity to an edge 306 of the panel 300. The light is received in the panel 300 through the edge 306. The light is then emitted from the side 304, which in this embodiment does not have the coating 310; the other side 302 has the coating 310. In this example, two panels 300 are being used, one on each side of the cavity 410. In one embodiment, the cavity 410 could include openings 416, 418 in the walls 412, 414 to allow the light to pass into the interior of the cavity 410, if that is the intended lighting application. Generally, a size of each of the openings 416, 418 should be larger that the coated area of the panel 300.

Referring to FIG. 5, another exemplary application of the aspects of the disclosed embodiments is illustrated. In this example, the panels 300 are disposed within the interior of the cavity 510. Some light sources, such as light emitting diodes, are sensitive to temperature and need to be kept in a cool environment. In an application such as an oven, the light emitting diode assembly 402 needs to be positioned away from the heat of the oven cavity 200. The aspects of the disclosed embodiments allow for the light to be transmitted from light emitting diodes 402 that are remote from the area to be illuminated. In the example shown in FIG. 5, the light emitting diode assembly 402 is external to, or on the outside of the cavity 510. The coated portion 310 of the panel 300 is on the interior of the cavity 510. Thus, the light source is removed from the desired area of illumination. This arrangement can be beneficial in a high heat environment, such as in the oven 100 of FIG. 2, where the light panel 300 is used to illuminate the interior of the oven cavity 200. The light emitting diodes 402 are kept in a cooler environment, relative to the oven cavity 200 of an operating oven 100.

FIG. 5 also illustrates that one or both sides of a panel 300 can include the coating 310, which can encompass more or less of the surface area of each side 302, 304 of the panel 300 that is exposed within the cavity 510. The gap area 308 on the panel 300 will generally not include a coating and can provide an area for the panel 300 to be inserted through an opening 502 in the wall 504 of the cavity 510. Although the use of three panels 300 is shown in FIG. 5, in alternate embodiments, more or less than three panels 300 can be implemented.

In the embodiment that is shown in FIG. 5, the panels 300 can comprise or be part of the oven cooking rack 218 shown in FIG. 2. In this embodiment, each panel 300 could comprise a sheet of ceramic material that can withstand the self-cleaning temperatures that can be achieved within the cavity 510. The panel 300 could include openings that are configured to allow air to flow through the panel 300. In one embodiment, the panel 300 can be suitably sized and adapted to replace the conventional oven cooking rack 218. In another embodiment, the panel 300 could be slightly smaller than the typical size of the conventional oven cooking rack 218 and suitably mounted or secured to a top or bottom surface of the conventional steel oven cooking rack 218.

Figure 6:
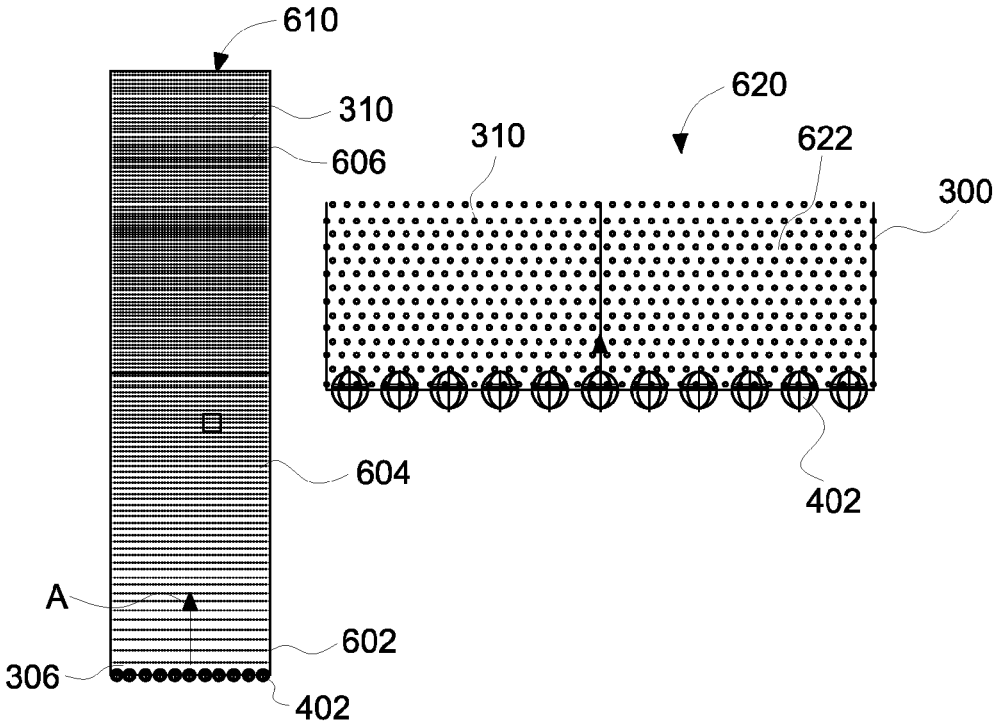
FIG. 6. illustrates exemplary coating patterns on a light transmitting panel in accordance with aspects of the disclosed embodiments.

In FIG. 6, the two panel assemblies 610 and 620 illustrate how the pattern of the coating 310 can be varied. On panel assembly 610 the coating 310 includes a pattern 602, which in this example is a series of dots. Moving in the direction indicated by arrow A, the density of the coating 310 in area 604 is less than the density in area 606. Thus, more light will be emitted from area 604 than 602. By adjusting the density of the pattern 602, the amount of light that is emitted can be varied from one area of the panel assembly 610 to another. Although this example shows a pattern 602 of increasing density, in alternate embodiments, the pattern 602 could be one of decreasing density or one that alternates between a period of increasing density and a pattern of decreasing density.

With respect to panel assembly 620, the coating 310 is of a constant density. In this example, the pattern 622 of coating 310 comprises a series of bumps or dots in a substantially constant pattern.

Figure 7:
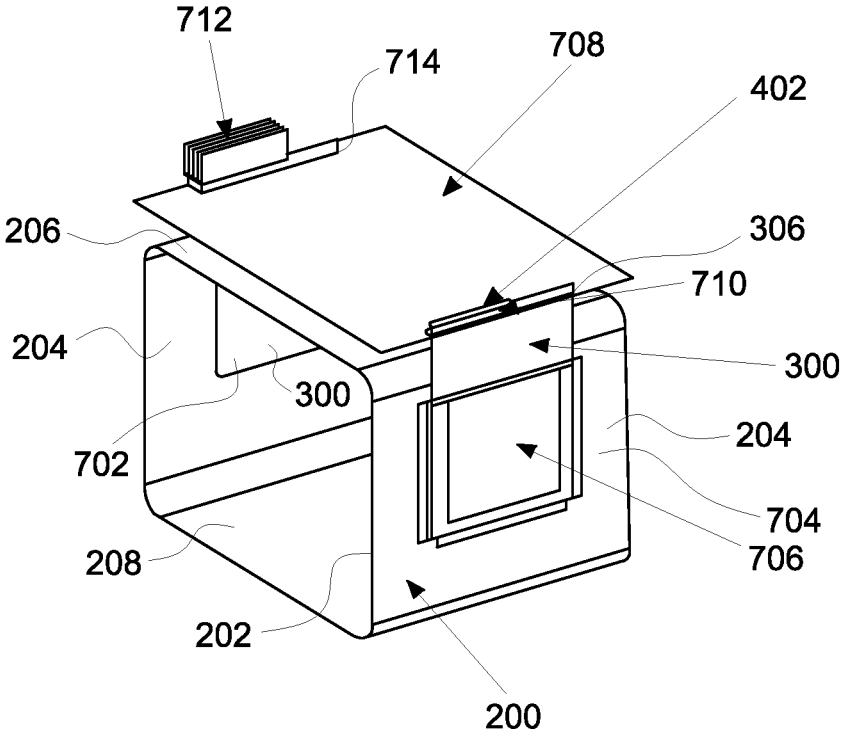
FIG. 7 is a perspective view of the oven liner portion of the oven cavity of the range illustrated in FIG. 2.

FIG. 7 illustrates perspective view of one embodiment of the oven cavity 200 shown in FIG. 2, with a lighting panel 300 mounted on each side 204 of the oven cavity 200. In this example, for descriptive purposes, only portions of the liner 202 of the oven cavity 200 are shown. A panel 300 is disposed on an external surface 704 of a side 204 of the oven cavity 200. The panel 300 is held in place, or mounted to the external surface 704 by a bracket 706. In this example, the bracket 706 is configured to slidingly engage the panel 300. In alternate embodiments, any suitable method of mounting a panel 300 to a surface 704 can be used. The side 204 includes an opening 702 that exposes a portion or side of the panel 300 to the interior area of the oven cavity 200 and allows light from the panel 300 to illuminate an interior portion of the oven cavity 200.

In one embodiment, the light emitting diode assembly 402 is located on an outside portion of a top insulation retainer 708. This allow the light emitting diode light source 402 to be located in a cool area relative to the high heat regions of the oven cavity 200. In one embodiment, a light emitting diode coupler 710 can be used to communicatively couple light from the light emitting diode light source 402 into the edge 306 of the panel 300. A heat sink 712 can also be used to draw heat away from the panel 300 and the light emitting diode 402. In this example, the panel 300 extends through an opening 714 in the top insulation retainer. In alternate embodiments, the panel 300 does not have to extend through the opening 714.

Figure 8:
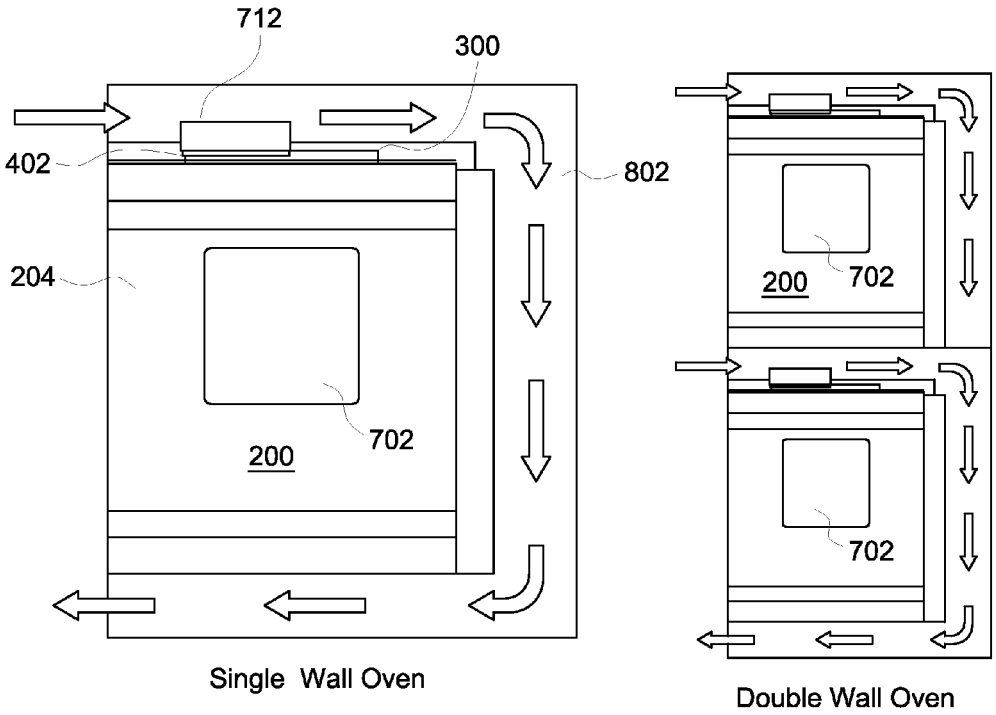
FIG. 8 illustrates exemplary air cooling patterns around the oven cavity shown in FIG. 7.

FIG. 8 illustrates an example where the airflow through the cooling ducts or pathways 802 can be used to cool the heat sink 712. As shown in FIG. 8, where examples of both a single wall oven and a double wall oven are shown, the heat sink 712 is positioned in the airflow path 802. The airflow will allow the heat sink to remove heat from the light emitting diode assembly 402 and panel 300 in the area of the light emitting diode assembly 402. Similar air flow paths can be provided for the oven in range 100 of FIG. 2.

Figure 9:
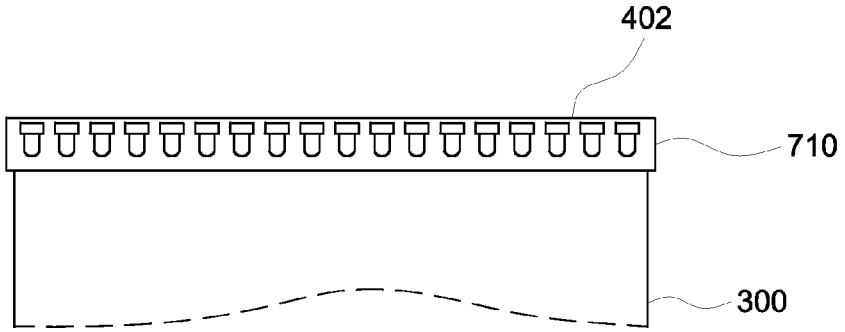
FIGS. 9 and 10 illustrate an exemplary coupling of an light emitting diode assembly to a light transmitting panel according to one aspect of the disclosed embodiments.
Figure 10:
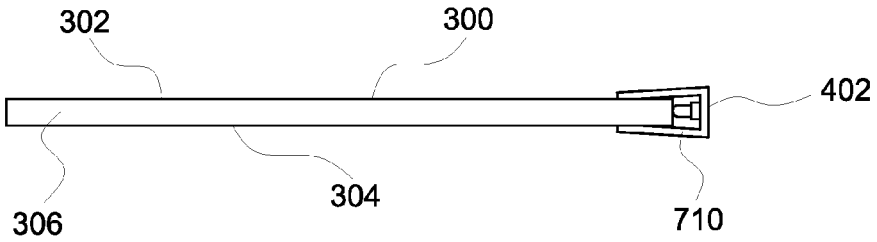

FIGS. 9 and 10 illustrate the positioning and coupling of the light emitting diode assembly 402 and LED coupler 710 with the panel 300. In this example, the LED coupler 710 fixedly retains and aligns the light emitting diode assembly 402 in close proximity to an edge 306 of the panel 300. Although this example shows the LED coupler 710 is in physical contact with the panel 300, in alternate embodiments, the LED coupler 710 does not attach to or contact the panel 300, but only secures and aligns the light emitting diode assembly 402 with the edge 306 of the panel 300.

Figure 11:
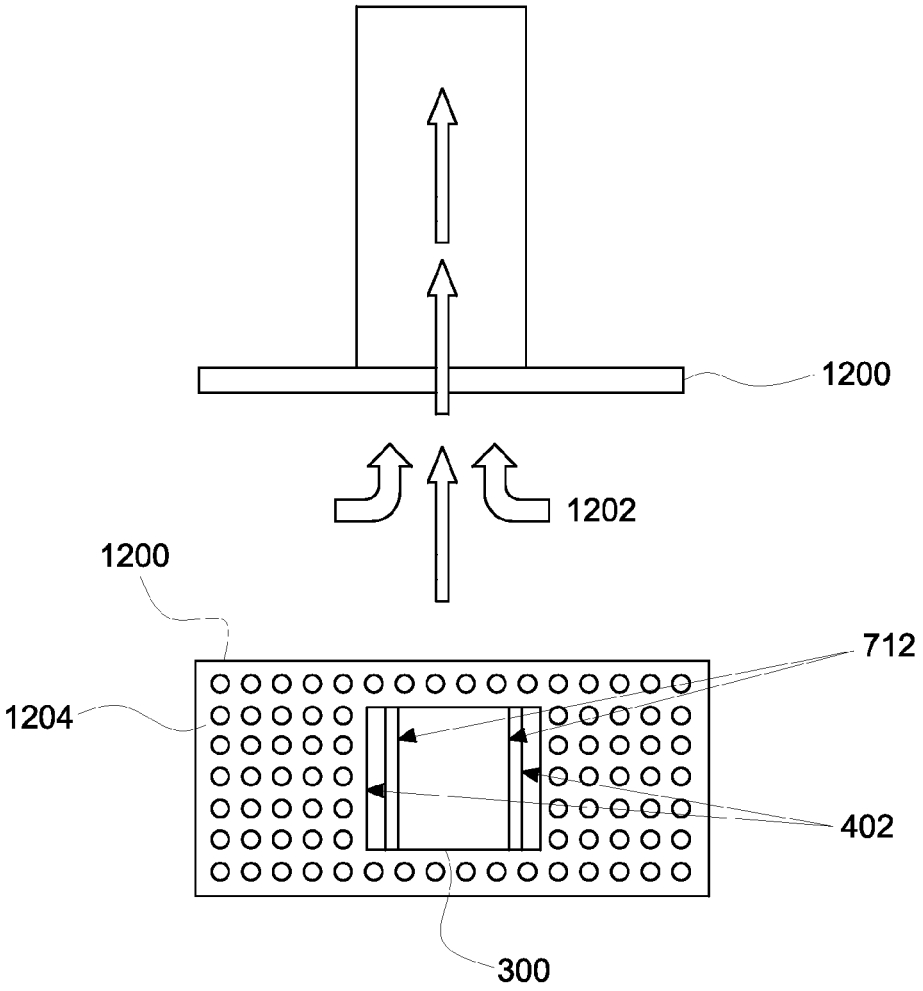
FIG. 11 illustrates an application of the disclosed embodiments in a vent hood for a range.

FIG. 11 illustrates an application of the disclosed embodiments on a vent hood 1200 for a range. In this example, the vent hood 1200 could be suitably mounted or arranged above the cooktop 120 of the range 100 shown in FIG. 1 in a manner that is generally understood. The vent hood 1200 is configured to create an airflow 1202 to draw air away from the cooktop 120 and oven 122 and into the vent hood 1200. As is generally known, vent hoods typically have a light source such as a bulb to illuminate the area under the vent hood 1200, such as the cooktop 120. In one embodiment, a panel 300 is mounted to the underside 1204 of the vent hood 1200. One or more light sources or LED arrays 402 can be used to feed light to the panel 300. Heat sinks 712 can be used to cool the light source 402 and panel 300.

The aspects of the disclosed embodiments make use of a light transmitting sheet or panel for illumination in appliance. A light source, such as a light emitting diode assembly, is placed in close proximity to an edge of the panel. The panel is coated to allow the light that enters the panel to be transmitted out from inside the panel. The coating can also be patterned in order to achieve a desired light output for a desired application. The panels can be mounted in any suitable location on an appliance to provide a desired illumination. In temperature sensitive applications, such as an oven, the light emitting diode assembly can be located in a relative cool area while the panel is located in the oven cavity. The light will remain trapped in the panel until it reaches a coated region, where the index of refraction exceeds the critical value and allows the light to escape.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An oven comprising:

an oven cavity with an oven cavity liner defining an interior of the oven cavity;

a cooling airflow pathway behind the oven cavity liner;

a light transmitting panel disposed on a surface of the oven cavity liner;

a light source for emitting light into the light transmitting panel through an edge of the light transmitting panel, the light source being located in proximity to the edge of the light transmitting panel, and remotely from the interior of the oven cavity, and part of the light source being located in the cooling airflow pathway; and a coating on a surface of the light transmitting panel and configured to allow light to diffuse from the coated surface of the light transmitting panel to the interior of the oven cavity.

2. The oven of claim 1, further comprising a panel bracket disposed on an exterior surface of the oven liner, the panel bracket configured to retain the light transmitting panel against an opening in the oven liner that is configured to allow the light from the light panel into the oven cavity.

3. The oven of claim 2, further comprising an insulation retainer disposed on an exterior of the oven cavity, the light source being disposed on a side of the insulation retainer away from the oven cavity, an edge of the light panel communicatively coupled to an opening in the insulation retainer, and the light source being communicatively coupled to the edge of the light panel.

4. The oven of claim 3, further comprising a light emitting diode coupler between the light source and edge of the light panel.

5. The oven of claim 1, wherein the coating includes a pattern, the pattern being configured to selectively diffuse light according to a density of the pattern.

6. The oven of claim 1, wherein the panel comprises a solid glass sheet that can withstand a temperatures up to 450 degrees centigrade.

7. The oven of claim 6, wherein the coating comprises a ceramic material.

8. The oven of claim 1, wherein the light source comprises a light emitting diode assembly.

* * * * *